US006074856A

United States Patent [19]

Wong et al.

[11] Patent Number: 6,074,856

[45] Date of Patent: Jun. 13, 2000

[54] USE OF SUGAR BEET PULPS FOR MAKING PAPER OR CARDBOARD

[75] Inventors: Emile Wong, Neyron, France; Massimo Bregola, Castelnovo Bariano, Italy

[73] Assignee: Eridania Beghin-Say, Thumeries, France

[21] Appl. No.: 09/125,203

[22] PCT Filed: Feb. 5, 1997

[86] PCT No.: PCT/FR97/00224

§ 371 Date: Aug. 21, 1998

§ 102(e) Date: Aug. 21, 1998

[87] PCT Pub. No.: WO97/30215

PCT Pub. Date: Aug. 21, 1997

[30] Foreign Application Priority Data

Feb. 13, 1996 [FR] France ..... 96 01724

[51] Int. Cl.[7] ..... C12P 7/56; D21H 23/04; A23P 7/10

[52] U.S. Cl. ..... 435/139; 435/170; 435/278; 162/99; 426/53; 426/54; 426/59

[58] Field of Search ..... 435/139, 278, 435/170; 162/99; 426/54, 53, 59

[56] References Cited

U.S. PATENT DOCUMENTS

| | | | |
|---|---|---|---|
| 1,150,119 | 8/1915 | Hosking | 426/54 |
| 3,612,306 | 10/1971 | Rambo | 214/17 |
| 4,789,551 | 12/1988 | Sayle | 426/54 |
| 4,832,791 | 5/1989 | Detert et al. | 162/99 |
| 4,949,633 | 8/1990 | Johnson et al. | 100/65 |
| 5,480,788 | 1/1996 | Devic | 435/168 |

FOREIGN PATENT DOCUMENTS

| | | |
|---|---|---|
| 0 358 554 | 3/1990 | European Pat. Off. . |
| 0 504 056 | 9/1992 | European Pat. Off. . |
| 0 644 293 | 3/1995 | European Pat. Off. . |

OTHER PUBLICATIONS

Suzzi et al, J. Appl. Bacteriol, 63:481–485, 1987.
Chemical Abstracts, vol. 90, No. 10, Mar. 5, 1979.

*Primary Examiner*—Francisco Prats
*Attorney, Agent, or Firm*—Young & Thompson

[57] ABSTRACT

The use of fermented sugar beet pulp for making paper or cardboard is disclosed as well as a fermented sugar beet pulp composition produced according to a method which comprises the steps of (a) storing the sugar beet pulp under conditions suitable for lactic acid fermentation, particularly until the pH is less than around 5 and advantageously higher than around 3.5, to give fermented pulp, (b) diluting the fermented pulp, particularly until its dry matter content is of around 1–10%, (c) mechanically processing the diluted fermented pulp to separate the parenchymal cells from the pulp and achieve a pulp size of less than around 1000 micrometers, and (d) optionally bleaching the fermented pulp from step (a) simultaneously with step (b), or bleaching the fermented pulp from step (c).

16 Claims, 1 Drawing Sheet

USE OF SUGAR BEET PULPS FOR MAKING PAPER OR CARDBOARD

TECHNICAL FIELD

The present invention relates to the use of fermented sugar beet pulps for making paper or board. The present invention also relates to a process for the production of fermented beet pulps. The present invention describes a method for treating beet pulps which makes it possible to obtain a product having good characteristics as a substitute ingredient in the production of paper.

BACKGROUND TO THE INVENTION

Paper is a film composed of a network of welded individual fibres. Generally speaking, its production entails a wet process involving cellulose fibres. The pulp is produced from wood and the composition varies depending on the grades of paper. The sheet is formed after draining a uniform deposit on a wire provided for this purpose. The long fibres (obtained from hardwood) allow the formation of a network in which are deposited the short fibres (obtained from softwood) and the combination contributes to the mechanical strength of the material formed after drying. Additives and loadings are very often employed to improve the characteristics such as appearance, porosity and surface condition.

Beet pulps are a by-product of the sugar beet processing industry. The beets are crushed and the sugar extracted with water. This operation is followed by pressing in order to increase the dry matter content to about 25 to 30%. The main components of beet pulps are, on average, cellulose (27%), hemicellulose (29%), pectin (29%), the minor components being sugar (3%), lignin (3%) and ash (4%). These components together form the characteristic cellular structure of beet pulps. This structure consists of parenchymal cells held together and bound crosswise by xylem and tubular phloem.

Few new economic methods of exploiting beet pulps have been developed, mainly because of the rapid degradation of this material. At present, the main use consists in drying the pulps, mixing them optionally with molasses and selling them as cattle feed (70% of European pulps in 1992).

Due to the high energy costs of drying, several attempts have been made to develop new uses and new treatments for undried beet pulps. The following conversions and uses have been studied: chemical or enzyme hydrolysis, production of ethanol, biogas, enzymes, and protein-rich cattle feed. As regards the possibility of using beet pulps in fields other than those mentioned above, the production of paper seems promising. The paper industry has to face considerable pressure from the environment to improve its yield, reduce pollution, use fewer chemicals and increase recycling. The combination of these factors is not an objective that can be reached directly, and new processes and additives are constantly being developed. Until now, the use of fresh or fermented beet pulps has not been achieved. The main reasons are the small proportion of cellulose contained in the pulps and the cell structure which does not make it possible to obtain long fibres that could, for example, replace wood fibres. Consequently, beet pulps are not regarded as suitable for the production of paper as a simple wood substitute.

However, the use of dried beet pulps for the production of paper is well known. Some authors have even described the possibility of using overpressed and ultrapressed beet pulps in the production of paper (G. VACCARI et al., XX General Assembly of CITS, Munich, Jun. 26–30, 1995).

Some work has been done to obtain a material suitable for the production of paper from beet pulps. When it is used as a charge, the product originating from pulps is always the result of an extraction process.

The patent EP 0102 829 teaches a method for the separation of polymers from vegetable matter containing parenchymal cells under extreme pH conditions and at high temperature for a short reaction period. The cellulose material isolated, known as PCC (Parenchymal Cell Cellulose) is cited as being useful in food and possibly paper-making applications. But the process, which comprises a harsh chemical treatment followed by steam cracking and a separation/purification step, is complex and requires treatment of the effluent because of the chemicals used.

The patent CS 0174 308 describes a method for the production of paper from arabinose extraction residues of beet pulps.

The patent EP 0139 658 divulges a method for the depectinisation and dehydration of raw beet pulps. The raw pulps impregnated with acidified water undergo an alternating succession of compression and decompression steps. The mechanical work produces a kind of steeping of the pulp fibres. The fibres separate from one another, their directional arrangement disappears and the pectins are dissolved. The final dried product is suitable for paper production.

A single industrial process using beet pulps for the production of paper without any prior extraction has been described.

The patent EP 0644 293 reveals a process for grinding dried pulps and the use of said ground pulps as a paper charge. The dried pulps are ground and micronised. The resulting product is tested and used in the production of paper on an industrial scale. The characteristics of the paper obtained are comparable with those of the paper produced according to the same process but without beet pulps. In this process, the pulps are dried and the final charge product is not, therefore, commercially competitive compared with the other by-products such as sawdust or straw. Since the production of paper is a wet process, it does not seem useful to dry the charge which must then be rewetted afterwards. Moreover, the grinding of the dried pulps destroys the xylem and phloem which, without that, could help to increase the strength of the paper due to their fibrous structure.

The present invention relates to the use of fermented beet pulps in the production of paper. More particularly, this invention relates to a method of preparing a product derived from sugar beet pulps which may be added to the paper pulp in order to reduce the need for raw materials traditionally used in the production of paper.

SUMMARY OF THE INVENTION

A subject of the invention is to provide a method for treating beet pulps such that the treated pulps become both physically and economically suitable for use in the preparation of paper or board. The invention describes the paper or board containing beet pulps.

The present invention also describes a process for obtaining a preparation of fermented beet pulps comprising the following steps:

- the beet pulps are ensilaged under conditions that give rise to a lactic fermentation,
- the fermented pulps are diluted,
- the diluted fermented pulps undergo moderate mechanical shearing.

Ensilage is carried out according to known methods with pulps preferably containing 15 to 35% of dry matter. Ensilage is continued until the pH is at least less than about 5 and greater than about 3.5.

During ensilage, lactic acid is produced in a quantity that varies as a function of the sugars available. The lactic acid concentration generally ranges between 1 and 10% of the dry matter of the beet pulps.

The pulps are diluted to 1 to 10% of dry matter before moderate mechanical shearing. Shearing must be carried out in order to obtain an adequate distribution of the dimensions of the fermented pulps.

The present invention describes a paper or board composition containing from 1 to 50% and preferably from 2 to 25% (expressed as dry matter) of fermented beet pulps. The optimum quantities of fermented pulps added depend on the type of paper or board which is produced and on their desired characteristics. It is nevertheless preferable to replace wood fibres or waste paper by at least 10% (dry matter) of fermented pulps. Preferably, the fermented beet pulps are obtained according to the process of the invention.

The present invention reveals that the strength of the paper and board, measured by various parameters, is considerably increased by replacing a certain amount of the wood pulp normally used by the fermented beet pulps of the invention. In order to reduce the draining time of the composition thus obtained, it is preferable to use fermented beet pulps of which the distribution of dimensions is suitable. The diameter of the fraction of the fermented beet pulps used for the production of board is less than 1000 micrometers and preferably between 150 and 250 micrometers.

The present invention also makes it possible to reduce the draining time by adding flocculants.

Such flocculants may be chosen from the flocculants normally used for the treatment of waste water. The flocculants used in the present invention are preferably cationic polymers with a high molecular weight (more than 1 million).

Moreover, the present invention describes various kinds of paper and board which contain fermented beet pulps. These include white paper, recycled (brown) paper, and corrugated board.

DETAILED DESCRIPTION OF THE INVENTION

Figure 1:
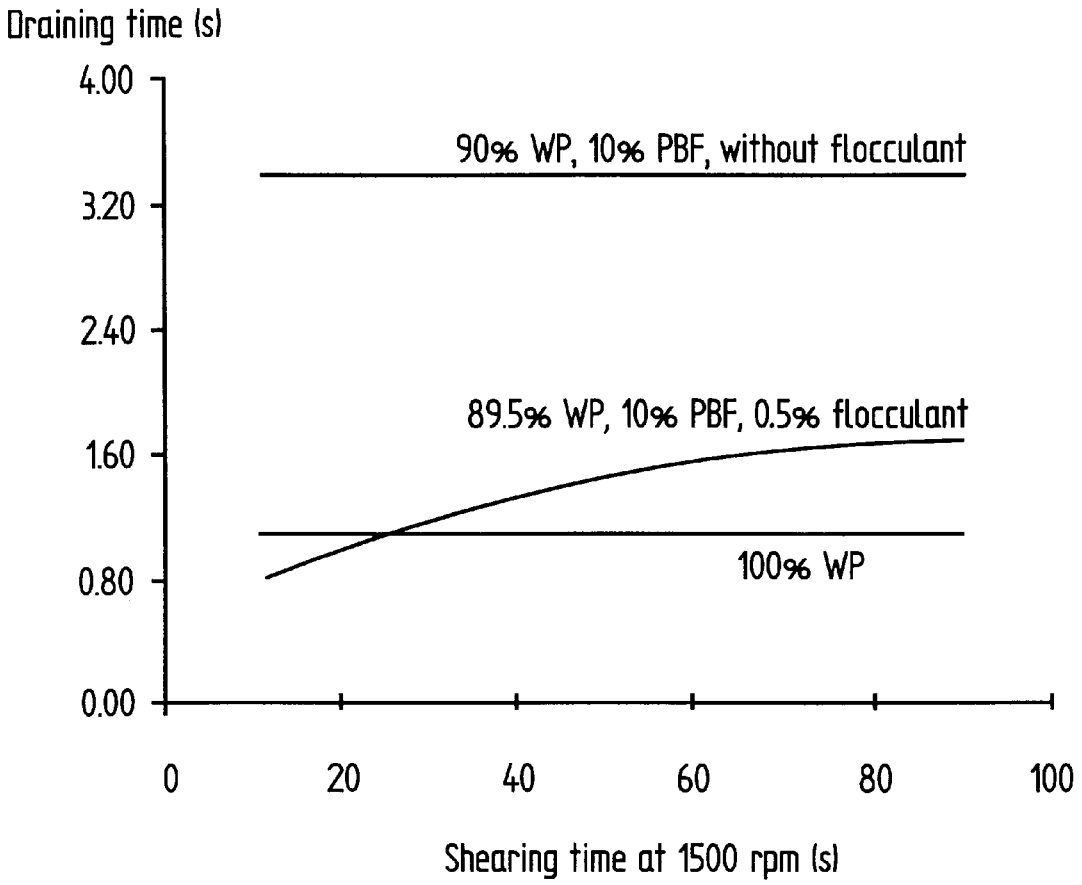
FIG. 1 is a graphical representation of draining time versus shearing time of waste paper/fermented beet pulps with and without flocculant addition.

It has now been found that, under certain conditions, wet pulps may be stored for a longer period and that the product obtained has characteristics which make it perfectly suitable for use for the production of paper and board.

When beet pulps are stored for a long period under anaerobic conditions, in silos or during ensilage, the pulps undergo a lactic fermentation. This results in a change in the pH and in the composition of the material.

The present invention divulges that after fermentation under these conditions, it is easier to separate the parenchymal cells and to obtain, by moderate mechanical wet shearing, a product suitable for the production of paper. It is possible to obtain, in this way, a suspension of cut xylem and phloem and of separate parenchymal cells which is suitable for direct incorporation in the final process for the production of paper by the wet method.

A subject of the present invention is to provide a method for treating beet pulps such that the treated pulps become both physically and economically suitable for use in the preparation of paper or board.

The invention describes a process for obtaining a composition of fermented beet pulps comprising the following steps:

the beet pulps are ensilaged under conditions that give rise to a lactic fermentation, the fermented pulps are diluted, the diluted fermented pulps undergo moderate mechanical shearing.

In the invention, the use of a composition of fermented sugar beet pulps in the production of paper or board may be regarded in particular as a substitute for short wood fibres.

Ensilage is carried out according to known methods with pulps preferably containing 15 to 35% of dry matter. Ensilage is continued until the pH is at least less than 5. The pulps are diluted to a dry matter content of 1 to 10% before moderate mechanical shearing.

It is known that pressed beet pulps may be ensilaged to protect them from unwanted decomposition. This process is most commonly used to protect this perishable product, the other alternative being drying to 90% dry matter. This drying has the disadvantage of being very energy-intensive, whilst it is not useful because the charge has to be rewetted when used in the wet process of paper production.

The fermentation process starts spontaneously under anaerobic conditions with the lactic bacteria present, without it being necessary to add a ferment. These microorganisms convert the residual sucrose of the pressed beet pulps to lactic acid, causing a fall in the pH and hence maintaining the structure of the beet pulps. It is also possible to carry out fermentation by inoculating the beet pulps with specific strains of microorganisms capable of developing well from polymer substances such as cellulose, pectin and hemicellulose and which degrade these polymers. The end of ensilage is associated with the microbiological state of the pulps and also depends on conditions such as the initial temperature, the temperature variations in the silo, the amount of sucrose still present, the oxygen content of the air enclosed, the humidity and the pH. When the correct conditions are applied, the result is a more flexible material the acidity of which is mainly due to the lactic acid and the pH of which is less than 5.

It has been found that the fermented beet pulps which have undergone a good lactic fermentation may readily undergo mechanical treatments in order to separate their parenchymal cells. The bonds between the cells are weaker than before fermentation, and moderate shearing is sufficient to separate the cells from one another whilst avoiding the formation of aggregates.

One method of treating the fermented pulps consists in lowering the dry matter content of the pulps from 15–35% to 1–10% by adding water or white water originating from the paper-making circuits. Afterwards, the suspension undergoes a mechanical treatment. The mechanical treatment may be carried out with various types of equipment and the resulting product preferably has a distribution of its dimensions that makes it ideally suitable for use in the production of paper or board. The treatment may be shearing or grinding. Well known treatments of beet pulps such as alternating compression and decompression and which are called "steam explosion" are not necessary. The mechanical treatment may be carried out directly during mechanical pulping of the pulp if a pulping or refining step is used. The use of the fermented beet pulps of the invention does not, therefore, require major investment in most of the existing paper-making plants.

Beet pulps have an ivory white colour and become greyish due to enzymatic phenomena or degradation by heat.

For paper applications, it is important that the fermented beet pulps can be bleached without loss of essential mechanical properties. The present invention reveals that such bleaching does not adversely alter the characteristics of the fermented beet pulps.

The heterogeneous suspension may be bleached with $H_2O_2$ or NaClO if a white product is desired; in this case, the bleaching agent may be added directly during dilution of the fermented pulps prior to the mechanical treatment.

The heterogeneous matter obtained, consisting of separate cells and short fibres of xylem and phloem, was used in a paper pulp formulation: laboratory sheets were produced and their properties evaluated in comparison with a reference.

The present invention describes a paper or board composition containing fermented beet pulps. The fermented beet pulps are used as an organic ingredient which improves the strength characteristics of the finished product. The amount of fermented beet pulps is from 0 to 50% and preferably between 2 and 25% of the weight of the dry matter of the ingredients of the paper or board. The optimum quantities of fermented beet pulps added depend on the type of paper or board produced and on their desired characteristics. It has been shown that replacing 15% of waste paper by fermented beet pulps was feasible.

The fermented beet pulps are preferably prepared in accordance with the process of the invention. The process of the invention does not use a chemical treatment of the fermented beet pulps. The process makes it possible to produce paper and board without producing additional chemical wastes.

The properties of the final paper sheets differ in a complex way depending on the type of wood pulp tested. Generally, improvements in opacity, breaking length, tear strength and "Dennison" are observed. At the same time, the draining time and the Shopper Riegler indices are increased for all the samples whereas the Bendtsen porosity is greatly reduced, and finally the brightness is lower whereas a bleaching as described above leads to an improvement.

The present invention reveals that the strength of the paper and board obtained by adding a certain amount of fermented beet pulps is considerably increased. It is preferable to control the reduction in the dimensions of the fermented beet pulps before using them in the preparation of pulp in order to avoid the excessive increase in the draining time of such a pulp. It has been shown that the preferred diameter of the fermented beet pulps is less than 1000 micrometers and more particularly from 150 to 250 micrometers for the preparation of corrugated board.

Example 1 teaches that before using fermented beet pulps, it is necessary to check that fermentation has been completed, that is, that the fermented product has not degraded. The pH and the amount of lactic acid formed are possible measures of the state of the beet pulps. A formulation of ingredients of the acid paper type was used to prepare sheets of paper. The composition of the paper was modified such that 10% of the fibres were replaced by fermented beet pulps.

In Example 1, the strength of the paper expressed in terms of breaking length, internal cohesion and tear strength is considerably increased.

Example 2 shows that it is possible to adapt easily the composition of the paper pulp if it is necessary to use fermented beet pulps in an existing paper-making process. The various methods of mechanical treatment of the paper pulp do not influence the characteristics of the paper obtained in a critical manner.

In Example 3, the use of fermented beet pulps was evaluated as a substitute additive in the production of corrugated board. If 10% of dry matter of fermented beet pulps are used with 90% of dry matter of a formulation without wood pulp, board having the desired strength characteristics is obtained.

As fermented beet pulps have an adverse effect on the brightness of the finished product, an evaluation was carried out as to whether bleaching the product containing fermented beet pulps was possible without adversely affecting the strength characteristics. As may be seen in Example 4, the tear strength and the breaking length remain high after bleaching.

The examples show that the strength of the finished product, paper or board, increases considerably with the addition of fermented beet pulps. On the other hand, the draining time of the paper composition becomes longer.

Example 5 shows that, when the fermented beet pulps are ground and strained then mixed with waste paper, the draining time is only slightly increased (sample 2) compared with the waste paper that underwent traditional pulping (reference), if the diameter of the product is between 150 and 250 micrometers. It may also be seen that the strength properties are influenced by the dimension of the fermented beet pulps. Screening the fermented beet pulps leads to slightly inferior strength properties compared with those of unscreened fermented beet pulps, but the two are considerably superior to the values measured on wood pulp.

This example shows that the beet pulps greatly influence the draining time and the strength properties. It has been shown that the product obtained, containing fermented beet pulps, has appreciable physical characteristics with only a slight increase in the draining time.

Finally, Example 6 shows that cationic flocculants with a high molecular weight normally used for the treatment of waste water are effective as draining additives.

The suspension of beet pulps flocculated by these chemicals leads to a paper composition having a considerably reduced draining time compared with that of a paper composition containing unflocculated beet pulps. The expression "reduced draining time" corresponds to the draining time of a paper composition in which there is no beet pulp.

These flocculants are very effective in spite of the dimensions of refined beet pulps. An additional improvement in the draining time may be obtained by adding flocculants to the screened beet pulps so as to combine the effects of Examples 5 and 6, namely screening of the beet pulps and the use of a flocculant.

The invention relates to the use of fermented sugar beet pulps for the preparation of paper or board.

According to an advantageous embodiment, the invention relates to a composition of fermented sugar beet pulps as obtained by the process comprising the following steps:

a) sugar beet pulps are ensilaged under conditions suitable for giving rise to a lactic fermentation and particularly until the pH is less than about 5, and advantageously greater than about 3.5, in order to obtain fermented pulps, b) the fermented pulps are diluted, particularly until the dry matter content is about 1% to about 10%, c) the diluted fermented pulps undergo a mechanical treatment, particularly shearing, allowing the parenchymal cells contained in the pulps to be separated and a pulp dimension of less than about 1000 micrometers to be obtained, d) optionally, the fermented pulps obtained at the end of step a) undergo bleaching at the same time as step b), or the fermented pulps obtained at the end of step c) undergo bleaching.

The addition of a flocculant may be carried out at the end of step c) defined above, that is, at the end of shearing of the fermented pulps.

According to another advantageous embodiment, the invention relates to a composition of fermented sugar beet pulps defined above as obtained by a process comprising the steps defined above, in which ensilage is carried out with sugar beet pulps of which the dry matter content is about 15 to about 35%.

According to another advantageous embodiment, the invention relates to a composition of fermented sugar beet pulps defined above in which the dimension of the beet pulps is less than 250 micrometers and in particular less than 150 micrometers.

The invention also relates to a process for the preparation of a composition of fermented sugar beet pulps comprising the following steps:

a) sugar beet pulps are ensilaged under conditions suitable for giving rise to a lactic fermentation, and particularly until the pH is less than about 5 and advantageously greater than about 3.5 in order to obtain fermented pulps, b) the fermented pulps are diluted, particularly until the dry matter content is about 1% to about 10%, c) the diluted fermented pulps undergo a mechanical treatment, particularly shearing, allowing the parenchymal cells contained in the pulps to be separated and a pulp dimension of less than about 1000 micrometers to be obtained, d) optionally, the fermented pulps obtained at the end of step a) undergo bleaching at the same time as step b), or the fermented pulps obtained at the end of step c) undergo bleaching.

According to another advantageous embodiment, the invention relates to paper or board containing about 1 to about 50% and preferably about 2 to about 25%, expressed with respect to dry matter, of a composition of fermented sugar beet pulps according to the invention.

According to another advantageous embodiment, the invention relates to the paper or board defined above, characterised in that the fermented sugar beet pulps have a dimension of less than 1000 micrometers and preferably from about 150 to about 250 micrometers.

According to another advantageous embodiment, flocculants may be added to the suspension of fermented beet pulps used for paper production. These flocculants are chosen from those available on the market, more particularly on the market for products for the treatment of waste water. More specifically, cationic polymers with a high molecular weight are effective for improving draining of the paper preparation.

According to another advantageous embodiment, the invention relates to the paper or board defined above, characterised in that the fermented sugar beet pulps are bleached.

The invention also relates to a process for the preparation of paper or board according to the invention, characterised in that:

a) sugar beet pulps are ensilaged under conditions suitable for giving rise to a lactic fermentation, and particularly until the pH is less than about 5 and advantageously greater than about 3.5 in order to obtain fermented pulps, b) the fermented pulps are diluted, particularly until the dry matter content is about 1% to about 10%, c) the diluted fermented pulps undergo a mechanical treatment, particularly shearing, allowing the parenchymal cells contained in the pulps to be separated and a pulp dimension of less than about 1000 micrometers to be obtained, d) optionally, the fermented pulps obtained at the end of step a) undergo bleaching at the same time as step b), or the fermented pulps obtained at the end of step c) undergo bleaching, e) the above-mentioned composition obtained at the end of step c) or d) is incorporated in a quantity of about 1 to about 50% and preferably about 2 to about 25%, expressed with respect to dry matter, in the traditional raw materials of paper pulp or board, optionally, a flocculant is added at the end of step c) or step e), preferably at the end of step c).

The addition of flocculant may be carried out at the end of step c) defined above, that is, at the end of shearing of the fermented pulps, or after step e), that is, after incorporation of the sheared, diluted, fermented pulps in the traditional materials of paper pulp or board.

Preferably, the flocculant is added at the end of step c).

The invention also relates to a process for the preparation of paper or board according to the invention, characterised in that:

a) sugar beet pulps are ensilaged under conditions suitable for giving rise to a lactic fermentation, and particularly until the pH is less than about 5 and advantageously greater than about 3.5 in order to obtain fermented pulps, b) the fermented pulps are diluted, particularly until the dry matter content is about 1% to about 10%, c) the composition obtained at the end of step b) is incorporated in a quantity of about 1 to about 50% and preferably about 2 to about 25%, expressed with respect to dry matter, in the traditional raw materials of paper pulp or board, d) optionally:

the fermented pulps obtained at the end of step a) undergo bleaching at the same time as step b), or the composition obtained at the end of step c) undergoes bleaching, e) pulping or refining of the composition obtained at the end of step c) or d) is carried out in combination with a mechanical treatment, particularly shearing, allowing the parenchymal cells contained in the fermented beet pulps to be separated and a pulp dimension of less than about 1000 micrometers to be obtained, optionally, a flocculant is added at the end of step c) or step e), preferably at the end of step c).

In the above and hereinafter, the opacity is defined with respect to the standard DIN 53146, the brightness is defined with respect to the standard DIN 53145 part II, the breaking length is defined with respect to the standard DIN 53112 part I, the internal cohesion is defined with respect to the standard DIN 54516, the tear strength is defined with respect to the standard DIN 53115, the Bendtsen porosity is defined with respect to the standard DIN 53120 part I, CMT is defined with respect to the standard DIN 53143, Dennison is defined in the Journal TAPPI 459om-88, the draining time and the degree of refining are defined in the Journal Zellcheming no. V/7/61.

EXAMPLE 1

Fermented beet pulps

The composition of the fermented beet pulps ensilaged in Italy during the 1994 campaign was analysed to find out whether they had undergone a good lactic fermentation. The following data were obtained:

TABLE 1

| Fermented beet pulps | |
|---|---|
| Dry matter | 26.50% |
| Ash | 1.38% |
| pH | 3.6 |
| Nitrogen | 1.66% |
| lactic ash/dry matter | 8.65% |
| Lactic acid/total acids | 71.00% |

These data show that the beet pulps underwent a good lactic fermentation. The pulps were then diluted to 2% dry matter and sheared in an Ika Ultra Turrax mixer.

The dimensions after shearing of the fermented pulps were measured with a series of Prolabo screens in comparison with fresh pulps. The results which are shown in Table 2 show the favourable effect of fermentation on the ease of disintegration of the beet pulps.

TABLE 2

| | Fresh pulps | Fermented pulps |
|---|---|---|
| Shear time | 2 min | 2 min |
| Dimensions of pulps (micrometres) | % by weight | % by weight |
| d > 500 | 81.8 | 27.2 |
| 500 > d > 200 | 4.3 | 21.5 |
| 200 > d > 125 | 0.7 | 3.7 |
| 125 > d > 80 | 0.5 | 4.1 |
| d < 80 | 12.7 | 43.5 |

A microscopic analysis of the suspension obtained showed clearly the presence of separate parenchymal cells. At the same time, the phloem and xylem structures were cut into smaller pieces and short beet tail fibres were obtained. The same kind of suspension was obtained after shearing more concentrated fermented beet pulps (7% dry matter) with a Frima colloid mill. For this reason, this latter equipment seems most suitable for an industrial application in paper-making works which do not have a refining step.

It was found that, with a twin disc refiner, for example, of the type produced by Sprout Walden, even more concentrated beet pulp suspensions could be refined. It was even possible to refine fermented beet pulps as such, that is, without any prior dilution (dry matter content 20 to 30%). However, this later refining condition leads to a very viscous suspension which is difficult to use in the subsequent steps of paper production.

A defined quantity of this suspension was dehydrated with ethanol in order to obtain a reference stock of dried fermented beet pulps. This stock was used as a reference material in the subsequent tests relating to the quality of the paper in order to have identical standard properties. Two series of laboratory sheets were produced and tested: the reference and MB. For the reference, a formulation of acid paper was used, prepared as described in Table 3, whilst for MB 10% of the fibres of the said formulation were replaced by a sample of the reference stock.

TABLE 3

| | | Reference | MB |
|---|---|---|---|
| Short fibres | parts | 65 | 60 |
| Long fibres | " | 35 | 30 |
| Beet pulps | " | 0 | 10 |
| Kaolin | " | 25 | 25 |
| Polymin SK | ppm | 200 | 200 |
| Consistency | g/l | 5 | 5 |
| pH | | 4.5 | 4.5 |
| Draining time | s | 0.28 | 0.36 |
| Degree of refining | °SR | 30 | 37 |
| Grams per square metre | $g/m^2$ | 80.5 | 80.6 |
| Opacity | % | 87.1 | 92.9 |
| Brightness | % | 82 | 68 |
| Breaking length | m | 3461 | 4384 |
| Internal cohesion | N | 141 | 177 |
| Tear strength | mJ/m | 1014 | 1216 |
| Density | $g/cm^3$ | 1.615 | 1.701 |
| Specific volume | $cm^3/g$ | 0.619 | 0.588 |
| Bendtsen porosity | ml/mn | 615 | 318 |

In the table above, the long fibres originate from a softwood such as pine wood and have a dimension of about 3.5 to 4.8 mm and the short fibres originate from a hardwood such as birch wood and have a dimension of about 0.7 to about 1.7 mm.

The sample was prepared by mixing short and long fibres and beet pulps in the proportions indicated. The degree of refining was that given in Table 3. The characteristics of the papers obtained are determined by standard methods. The sample containing the beet pulps of the reference stock, MB, showed an appreciable improvement in the strength indices and a slight increase in draining time whereas the porosity was significantly reduced.

The use of a reference stock proved to be very useful because, with a stable and readily available stock of material, it becomes possible to determine the relationship between the characteristics of the paper and the fermentation conditions of the beet pulps.

EXAMPLE 2

Refining fermented beet pulps for quality paper

The fermented beet pulps were treated with an Escher Wiss refiner in order to check that the equipment normally used in a paper plant is sufficiently effective for separating the parenchymal cells of the beet pulps without at the same time breaking the cells. The following tests were carried out:

TABLE 4

| | Test 1 Sample P | Test 2 Sample PR | Test 3 Sample MR |
|---|---|---|---|
| Pulping conditions | 4% dry matter 30 mn. Beet pulps only. | 4% dry matter 30 mn. Beet pulps only. | 4% dry matter 30 mn. 30% beet pulps, 70% reference* |
| Refining conditions | | 2% dry matter 4 mn. Beet pulps only. | 2% dry matter 4 mn. 30% beet pulps, 70% reference* |

*NB: The reference consists of a formulation without wood pulp prepared with unselected fluted paper repulped to 30°SR.

Sample P showed the presence of rather coarse pieces whereas the two other samples PR and MR have pieces with dimensions comparable with those of the tests with the colloid mill. The samples were evaluated after producing sheets and having used for each 10% of dry matter of fermented beet pulps and 90% of the formulation (*) without wood pulp. The data were compared with 100% of a formulation without wood pulp (reference) (*) and with a sample MB1 containing 10% of material of the reference stock and 90% of the formulation (*) without wood pulp.

TABLE 5

| | | Reference | MB1 | MR | PR | P |
|---|---|---|---|---|---|---|
| Kaolin | parts | 25 | 25 | 25 | 25 | 25 |
| Polymin SK | ppm | 200 | 200 | 200 | 200 | 200 |
| pH | | 4.5 | 4.5 | 4.5 | 4.5 | 4.5 |
| Draining time | s | 0.28 | 0.36 | 0.7 | 0.55 | 0.54 |
| Degree of refining | °SR | 30 | 37 | 45 | 42 | 42 |
| Grams per sq. m. | $g/m^2$ | 80.5 | 80.6 | 82 | 81.7 | 80.8 |
| Opacity | % | 87.1 | 92.9 | 91.8 | 92.5 | 90.5 |
| Brightness | % | 82 | 68 | 70.5 | 70 | 71.8 |
| Breaking length | m | 3461 | 4384 | 4475 | 4409 | 4458 |
| Internal cohesion | N | 141 | 177 | 160 | 177 | 181 |
| Tear strength | mJ/m | 1014 | 1216 | 1260 | 1211 | 1224 |
| Density | $g/cm^3$ | 1.615 | 1.701 | 1.706 | 1.678 | 1.664 |
| Specific volume | $cm^3/g$ | 0.619 | 0.588 | 0.586 | 0.596 | 0.601 |
| Bendtsen porosity | ml/mm | 615 | 318 | 240 | 272 | 280 |

As regards the increase in the strength of the paper, it may be seen that there is no great difference between the various types of mechanical treatment. A longer draining time for the mixed pulped and refined sample (MR) is, however, observed. This result could be due to the increase in the soluble fraction released inside the pulps during the refining step.

* NB: The reference consists of a formulation without wood pulp prepared with unselected fluted paper repulped to 30°SR.

EXAMPLE 3

Refining of fermented beet pulps to produce fluted paper.

Some tests were carried out by mixing fermented beet pulps with brown waste paper. The purpose of these tests was to determine whether the fermented beet pulps could improve the characteristics of the waste paper used to produce fluted paper, without greatly altering the conditions of preparation.

High CMT values (Concora Medium Test), high rigidity, internal cohesion and bursting pressure values are obtained for the fluted paper by adding starch to the waste paper during production. The fermented beet pulps could be attractive from an economic point of view as a starch substitute, provided that these pulps significantly increase the desired characteristics whilst at the same time reducing the amount of starch required. On the other hand, it would be necessary to avoid increasing some parameters such as draining time, the degree SR, the COD, conductivity and turbidity during the production of the paper sheets. The evaluation of the laboratory sheets was carried out with different quantities of fermented beet pulps (PBF) in the waste paper (reference).

TABLE 6

| | | Reference | 5% PBF | 10% PBF | 15% PBF | 10% PBF |
|---|---|---|---|---|---|---|
| PAC* | % | 0.2 | 0.2 | 0.2 | 0.2 | 0.2 |
| Grams per square metre | $g/m^2$ | 100.2 | 98.7 | 100 | 99.7 | 100.6 |
| Bendtsen porosity | ml/mm | 416 | 242 | 158 | 99 | 134 |
| Internal cohesion | N | 93 | 103 | 115 | 125 | 116 |
| CMT 30 | N | 91 | 105 | 113 | 122 | 117 |
| Rigidity | mN | 760 | 739 | 795 | 772 | 798 |
| Bursting pressure | kPa | 146 | 155 | 165 | 173.5 | 156.5 |
| Draining time | s | 1.51 | 2.31 | 3.79 | 8.09 | 3.39 |
| Turbidity | absorbance | 0.646 | 0.632 | 0.62 | 0.592 | 0.518 |
| COD | mg/l | 733 | 1140 | 1183 | 1212 | 2050 |
| Conductivity | ms/cm | 580 | 594 | 590 | 568 | 535 |

TABLE 6-continued

| | | Reference | 5% PBF | 10% PBF | 15% PBF | 10% PBF |
|---|---|---|---|---|---|---|
| Degree of refining | °SR | 38 | 44 | 51 | 54 | 48 |

*Poly Aluminum Chloride
Note: Reference = brown paper obtained by repulping unselected fluted paper.

It may be observed that with the increase in the quantity of beet pulps in this corrugated board, the quality of the paper defined by the internal cohesion, the CMT 30 and the bursting pressure increases. It is also observed that the porosity falls to 100 ml/mn for the highest quantity of beet pulps, that is, 15%. No effect of the quantity of beet pulps on the rigidity is observed.

The maximum quantity of beet pulps possible in the production of corrugated board seems to be 10% because of the resulting high value of the draining time. A subsequent improvement in the draining characteristics might make it possible to increase the amount of beet pulps in the pulp.

EXAMPLE 4

Bleached fermented pulps

Fermented beet pulps, ensilaged after the 1993 campaign, were sheared mechanically. $H_2O_2$ was added during dilution (4% based on dry matter). The suspension obtained was then used for the paper sheet tests (10% of bleached fermented beet pulps, 90% of the formulation of acid paper described in Example 1) and the results are compared with a reference (the same as in Example 1) as shown below.

TABLE 7

| | | Reference | Bleached pulps |
|---|---|---|---|
| Zeta potential | mV | −32.25 | −42.49 |
| Draining time | s | 0.41 | 0.74 |
| Degree of refining | °SR | 30 | 46 |
| Grams per sq. metre | g/m$^2$ | 79.3 | 79.6 |
| Opacity | % | 87.6 | 88.1 |
| Brightness | % | 79.5 | 76.2 |
| Ash | % | 8.6 | 6.9 |
| Breaking length | m | 3281 | 4194 |
| Dennison | | 8 | 11 |
| Tear strength | mJ/m | 828 | 986 |
| Density | g/cm$^3$ | 0.645 | 0.607 |
| Specific volume | cm$^3$/g | 1.551 | 1.649 |
| Bendtsen porosity | ml/mn | 830 | 404 |

Bleaching the sample leads to better brightness compared with the unbleached product. Moreover, good results are again observed as regards the strength properties such as tear strength, breaking length and "Dennison". These data indicate that the use of fermented beet pulps is suitable for the production of white paper.

EXAMPLE 5

Draining time of fermented beet pulps

In the preceding Examples 2 and 3, the physical properties of the paper containing fermented beet pulps were measured under test conditions. The mixture of paper/fermented beet pulp was pulped and refined with treatment times only suitable for improving the paper, but without optimising the treatment time of the beet pulps. Moreover, no screening stage was carried out even though this is necessary during the industrial production of paper. It is known that the dimensions of the paper fibres suitable for corrugated board must be between 150 and 250 micrometers.

For these reasons, a test was carried out using a mixture containing 90% pulped and refined waste paper and 10% screened fermented beet pulps with dimensions from 150 to 250 micrometers.

The result of this test is given below.

TABLE 8

| | | Reference 100% pulped & refined WP | Sample 1 90% WP + 10% PBF PBF pulped and refined with the WP | Sample 2 90% WP + 10% PBF Screened PBF added to pulped and refined WP |
|---|---|---|---|---|
| Grams per sq. m. | g/m$^2$ | 122 | 121 | 122 |
| Draining time | s | 0.98 | 5.51 | 1.60 |
| CMT 30 | N | 162 | 195 | 180 |
| Rigidity | mN | 1218 | 1411 | 1394 |
| Internal cohesion | N | 135 | 166 | 144 |
| Bursting pressure | kPa | 254 | 316 | 242 |

WP = waste paper obtained by repulping unselected fluted paper
PBF = fermented beet pulps These data show that when the fermented beet pulps are ground and screened then mixed with waste paper, the draining time is only slightly increased (sample 2) compared with waste paper which underwent traditional mechanical pulping (reference). The draining time of sample 2 is in fact comparable with that of the reference whereas it is more than three times lower than that of sample 1.

It may also be seen that the strength properties are slightly affected by the dimensions of the fermented beet pulps. Nevertheless, the screened fermented beet pulps have strength properties comparable with those of unscreened pulps and both are considerably superior to the values found for wood pulp.

This example shows that the dimensions of the beet pulps greatly influence the draining time and the strength properties. It was shown that a product containing fermented beet pulps having appreciable physical properties and only a slight increase in the draining time is obtained.

EXAMPLE 6

Use of flocculants as draining additives

Example 5 shows that the use of screened fermented beet pulps with dimensions from 150 to 250 micrometers nevertheless leads to an increased draining time, even though this increase is much smaller than when unscreened fermented beet pulps are used.

Another way of reducing the draining time is to use flocculants. Cationic flocculants with a high molecular weight are capable of flocculating the beet pulp suspensions used for the production of paper. These include: Zetag 89® from Allied Colloids, Bufloc 5327® and 5328® from Buckman, Floerger 4698® from SNF Floerger and the products of Nalco. The use of flocculated beet pulps for the production of paper leads to correct draining times. However, the extent of this improvement depends on several factors such as the shearing of the paper suspension during production, the amount of flocculant, and the ways in which the flocculant is used.

The draining time of a composition for paper containing 89.5% waste paper, 10% fermented beet pulp and 0.5% flocculant (Floerger 4698® from SNF Floerger) was measured with the Techpap draining jar with different shear times (FIG. 1).

FIG. 1 shows that the draining time depends on the shear time when a flocculant is added. With low shear, the mixture of waste paper/flocculated beet pulps drains better than waste paper alone.

The laboratory sheets obtained by using flocculated beet pulps were characterised physically. As may be seen from Table 9, the good strength properties were retained despite flocculation. Moreover, the use of flocculant leads to an appreciable reduction in the COD of the waste water.

TABLE 9

| | | 100% WP | 90% WP 10% PBF without flocculant | 90% WP 10% PBF with flocculant |
|---|---|---|---|---|
| Waste paper | % on dry matter | 100 | 90 | 89.5 |
| Best pulps | % on dry matter | — | 10 | 10 |
| Flocculant | % on dry matter | — | — | 0.5 |
| Shear time | s | 90 | 90 | 90 |
| Draining time | s | 1.12 | 3.39 | 1.80 |
| COD | mg/l | 310 | 430 | 230 |
| Grams per square metre | $g/m^2$ | 112 | 116 | 116 |
| Density | $g/cm^3$ | 0.56 | 0.56 | 0.54 |
| Bendtsen porosity | ml/mm | 159 | 56 | 123 |
| Rigidity | mN | 902 | 1180 | 1062 |
| Bursting pressure | kPa | 227 | 261 | 243 |
| Internal cohesion | N | 141 | 117 | 136 |
| CMT 30 | N | 124 | 145 | 141 |

WP = waste paper
PBF = fermented beet pulps

What is claimed is:

1. A process for the preparation of paper or board comprising: adding fermented sugar beet pulp in a quantity of about 1% to about 50% expressed with respect to dry matter content, to other raw materials of paper pulp or board, and wherein the fermented sugar beet pulp is prepared according to the following steps:

a) ensilaging sugar beet pulps under conditions suitable to cause a lactic acid fermentation and a pH change in order to obtain fermented pulps; and b) subjecting the fermented pulps to a mechanical treatment to separate parenchymal cells contained in the pulps and obtain a product having a dimension of less than about 1000 micrometers.

2. A process according to claim 1, wherein in step a) the sugar beet pulps are ensilaged until the pH is less than about 5.

3. A process according to claim 1, wherein in step a) the sugar beet pulps are ensilaged until the pH is greater than about 3.5.

4. A process according to claim 1, wherein between steps a) and b) the fermented pulps are diluted until the dry matter content is about 1% to about 10%.

5. A process according to claim 4, wherein the mechanical treatment which the diluted fermented pulps undergo is shearing.

6. A process according to claim 1, wherein the fermented pulps obtained at the end of step a) are bleached.

7. A process according to claim 1, wherein the fermented pulps obtained at the end of step b) are bleached.

8. A process according to claim 1, wherein ensilage is carried out with sugar beet pulps having a dry matter content of about 15% to about 35%.

9. A process according to claim 1, wherein a flocculant is added at the end of the fermentation step.

10. A process according to claim 6, wherein a flocculant is added after the bleaching step.

11. A process according to claim 1, wherein the product of the mechanical treatment of step b) has a dimension of less than 250 micrometers.

12. A process according to claim 1, wherein the product of the mechanical treatment of step b) has a dimension of less than 150 micrometers.

13. Paper or board containing about 1 to about 50%, expressed with respect to dry matter content, of a composition of fermented sugar beet pulps, and wherein the composition is prepared according to the following steps:

a) sugar beet pulps are ensilaged under conditions suitable to cause a lactic acid fermentation in order to obtain fermented pulps; and b) the fermented pulps are subjected to a mechanical treatment which results in the separation of parenchymal cells contained in the pulps and a product having a dimension of less than about 1000 micrometers.

14. Paper or board according to claim 13 containing about 2 to about 25% of the composition of fermented sugar beet pulps expressed with respect to dry matter content.

15. Paper or board according to claim 13, wherein the fermented sugar beet pulps are bleached.

16. Paper or board according to claim 14, wherein the fermented sugar beet pulps are bleached.

* * * * *